US005277012A

United States Patent [19]

Woolbright

[11] Patent Number: 5,277,012

[45] Date of Patent: Jan. 11, 1994

[54] RETAINING WALL BUILDING BLOCK

[76] Inventor: Mark A. Woolbright, 232 N. Kingshighway, Suite 1207, St. Louis, Mo. 63108

[21] Appl. No.: 918,290

[22] Filed: Jul. 22, 1992

[51] Int. Cl.[5] ..... E04C 3/00

[52] U.S. Cl. ..... 52/589; 52/608

[58] Field of Search ..... 52/589, 169.4, 585, 52/608; 47/83; 405/284-287

[56] References Cited

U.S. PATENT DOCUMENTS

| | | | |
|---|---|---|---|
| D. 217,244 | 4/1970 | Fairfield | D25/1 |
| D. 296,007 | 5/1988 | Forsberg | D25/116 |
| D. 296,365 | 6/1988 | Forsberg | D25/116 |
| D. 300,253 | 3/1989 | Forsberg | D25/114 |
| D. 300,254 | 3/1989 | Forsberg | D25/114 |
| D. 310,267 | 8/1990 | Zeidman | D25/112 |
| 1,015,584 | 1/1912 | Powell . | |
| 1,349,552 | 8/1920 | Baumann . | |
| 3,073,061 | 1/1963 | Pearson | 47/34 |
| 3,389,499 | 6/1968 | Haile | 47/33 |
| 4,060,952 | 12/1977 | Hernandez | 52/593 |
| 4,107,894 | 8/1978 | Mullins | 52/593 |
| 4,229,123 | 10/1980 | Heinzmann | 405/273 |
| 4,379,659 | 4/1983 | Steiner | 405/284 |
| 4,426,176 | 1/1984 | Terada | 405/285 |
| 4,521,138 | 6/1985 | Steiner | 405/284 |
| 4,565,043 | 1/1986 | Mazzarese | 52/593 |
| 4,671,706 | 6/1987 | Giardini | 405/286 |
| 4,684,294 | 8/1987 | O'Neill | 405/286 |
| 4,914,876 | 4/1990 | Forsberg | 52/169 |
| 4,920,712 | 5/1990 | Dean, Jr. | 52/169 |
| 4,930,283 | 6/1990 | Winkler | 52/611 |
| 5,003,746 | 4/1991 | Wilston | 52/589 |
| 5,044,834 | 9/1991 | Janopaul, Jr. | 405/284 |
| 5,066,169 | 11/1991 | Gavin et al. | 405/284 |
| 5,072,566 | 12/1991 | Zeidman | 52/608 |

FOREIGN PATENT DOCUMENTS 2651258 3/1991 France .

OTHER PUBLICATIONS

Seagren Industries, Inc., St. Louis, Mo., Loffelstein Retaining Walls, pp. 1-4 and insert, Circa. 1990.

Kiltie Corporation, North St. Paul, Mn., Versa-Lok Retaining Wall Systems, Foldable insert, 1989.

Keystone Retaining Wall Systems, Inc., Minneapolis, Mn., Compac Unit, pp. 1 and 2, 1990.

Keystone Retaining Wall Systems, Inc., Minneapolis, Mn., Keystone Retaining Wall Systems, Foldable insert, 1991.

Allan Block Corporation, Bloomington, Mn., Allan Block Retaining Walls, pp. 1-4 and two inserts, 1990.

Stone Wall, Lanscape Retaining Wall System, pp. 1-4 and one insert, Circa. 1990.

*Primary Examiner*—Carl D. Friedman

*Assistant Examiner*—Beth A. Aubrey

*Attorney, Agent, or Firm*—Senniger, Powers, Leavitt & Roedel

[57] ABSTRACT

A retaining wall building block comprises a face wall and two side walls extending rearwardly from the face wall from the opposite ends thereof with the face wall and two side walls being shaped and arranged such that the block has a generally C-shaped configuration as viewed from above. An ear projects outwardly from one of the side walls. A notch is provided in the other of the side walls for receiving the ear of a second building block of identical construction when the blocks are placed in side-by-side relation. The blocks may pivot relative to one another about a generally vertical axis such that a plurality of blocks of substantially identical construction may be selectively arranged in a variety of configurations ranging from a generally straight-line configuration, a generally convex configuration and a generally concave configuration.

26 Claims, 3 Drawing Sheets

RETAINING WALL BUILDING BLOCK

BRIEF SUMMARY OF THE INVENTION

This invention relates to retaining walls in general, and more particularly to a retaining wall building block constructed to facilitate building walls having a variety of configurations.

In constructing a retaining wall, there are currently available a wide variety of building blocks, each tailored to a particular use. Generally, a retaining wall may be constructed with building blocks made from natural sources such as timber, granite or stone, or with man-made materials such as concrete. Man-made materials typically cost less than most natural materials and are more versatile since they may be formed to desired shapes and configurations. Builders have moved away from constructing retaining walls with such natural products and have recently been utilizing such man-made materials.

In some applications, the retaining wall is configured in a generally straight line. However, many times it is desirable for the wall to have a curved contour, such a concave or convex contour as viewed from above. Some blocks are designed specifically for attaining curved wall contours, however, the blocks presently available are extremely limited in forming curved walls having a small radius of curvature. The building blocks shown in U.S. Pat. Nos. 4,379,659, 4,671,706 and 5,072,566 are examples of blocks which can be used to build retaining walls, but are limited in being able to form contoured walls with the requisite structural integrity.

Typically, blocks are placed in a side-by-side relation in layers or courses, in which a block on a second course overlaps two blocks on the first course, thereby providing structural support and stability. Many blocks, such as those shown in U.S. Pat. Nos. 4,379,659, 4,671,706 and 5,072,566 have troughs in which fill (e.g., sand or gravel) can be packed to increase the weight of the block and provide an additional stabilizing force which prevents the relative movement of the blocks. To provide additional support, the blocks may be constructed with pins which hold the courses secure relative the courses disposed beneath and above. Another method for supporting the retaining wall is to place a geo-grid mesh between courses of blocks in which the grid runs into the earth.

Also, in forming the retaining wall, the blocks may be stacked such that they form a set back (the angle of the wall relative to a horizontal plane) of less than ninety-degrees as viewed from the side. Many blocks (e.g., U.S. Pat. No. 4,671,706) are limited in the degree of set back they are capable of attaining. Depending on the landscaping requirements, it may be necessary to build the wall anywhere from twenty-five to ninety degrees relative the horizontal plane.

In the retaining wall building block industry, it is desirable to have versatile building block having many features described above while maintaining its structural integrity and an asthetically pleasing appearance.

Accordingly, among the several objects of this invention may be noted the provision of improved retaining wall building blocks which are versatile; the provision of such building blocks in which multiple blocks may be arranged to form a retaining wall having a curved contour (e.g., concave and convex contours) as viewed from above; the provision of such building blocks which are capable of being stacked or placed upon each other to attain a wide range of setback from as steep as ninety degrees to as gentle a slope as twenty-five degrees; the provision of such building blocks which may be arranged to form a retaining wall which is structurally strong without having to use pins or a mesh to increase its structural strength; the provision of such building blocks which provide necessary drainage to the landscape it retains; and the provision of such building blocks which are simple in construction and manufacture, and easy to use.

In general, a retaining wall building block constructed according to the principles of the present invention comprises a face wall lying generally in a vertical plane and having laterally opposite ends. Two side walls extend rearwardly from the opposite ends of the face wall with the face wall and two side walls being shaped and arranged such that the block has a generally C-shaped configuration as viewed from above. Flange means projects outwardly from one of the side walls and is located generally intermediate the forward and rearward edges of said one side wall. Flange receiving means is provided in the other of the side walls generally intermediate the forward and rearward edges of said other side wall. The flange receiving means receives the flange means of a second building block of identical construction when the blocks are placed in side-by-side relation and to allow the blocks to pivot relative to one another about a generally vertical axis while maintaining said flange means engaged in said flange receiving means such that a plurality of blocks of substantially identical construction may be selectively arranged in a variety of configurations ranging from a generally straight-line configuration, a generally convex configuration and a generally concave configuration.

In another aspect of the invention, the retaining wall building block comprises a face wall lying generally in a vertical plane and having laterally opposite ends Two side walls extend rearwardly from the face wall from the opposite ends thereof. The face wall and two side walls are shaped and arranged such that the block has a generally C-shaped configuration as viewed from above. The face wall extends from a generally horizontal plane higher than the walls and has a width of generally one-half the greatest width of the block for facilitating the attainment of a substantially vertical wall when blocks of identical construction are stacked to form a retaining wall.

In a third aspect of the invention, a retaining wall comprises a plurality of substantially identical building blocks placed in side-by-side relation and stacked in a staggered configuration one on top another such that a face wall of a block on an upper course is positioned generally between two face walls of two blocks positioned on a course immediately below the upper course.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 3:
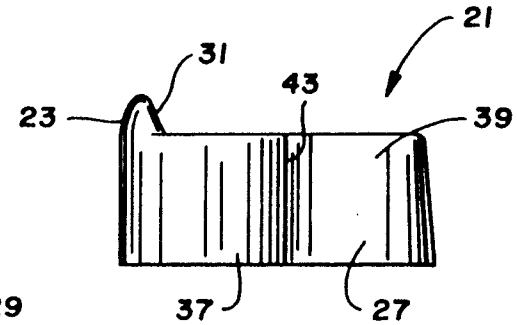
FIG. 3 is a right side elevation thereof.
Figure 2:
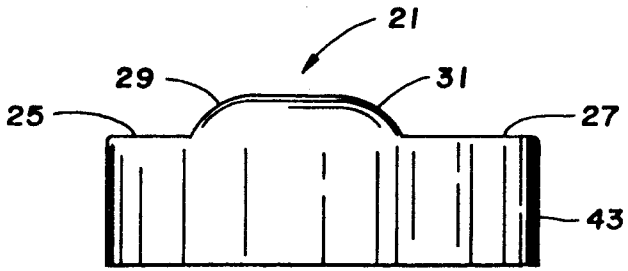
FIG. 2 is a front elevation of the block shown in FIG. 1.

Referring to the drawings, there is shown a retaining wall building block, generally indicated at 21, of a first preferred embodiment. In general, a retaining wall is formed by placing building blocks side-by-side in a row and stacking multiple rows in layers or courses, in which a block of a second course overlaps two blocks on the first course (upon which it rests). Building block 21 includes a face wall 23 lying generally in a vertical plane and two side walls 25, 27 extending rearwardly from the face wall. The face wall 23 has laterally opposite ends 29, 31 from which side walls 25, 27 extend. Each side wall also has laterally opposite ends; side wall 25 having ends 33, 35 and side wall 27 having corresponding ends 37, 39. As shown in FIG. 2, the face wall 23 and the two side walls 25, 27 are shaped and arranged such that the block 21 has a generally C-shaped configuration as viewed from above. More specifically, the face wall is generally planar, however, it is slightly curved between ends 29, 31 inward towards the center of the block with the center of the radius of curvature being the center of the block. As shown, the side walls 25, 27, are curved between their lateral ends with the radius of curvature being the center of the block. Side wall 25 is curved inwards between ends 33, 35, and likewise, side wall 27 is curved inwards between ends 37, 39. Building block 21 further includes a generally horizontal, planar base 41 in which the face wall 23 and two side walls 25, 27 project upwardly therefrom. A trough T is defined by the face wall 23, side walls 25, 27 and base 41 which may be loaded with fill such as gravel or dirt to increase the weight of the block. The upper surface of the base 41 is curved radially upwardly as indicated at 42 to prevent water from being trapped in the center of the trough T. When installed on a level plane, the upper surface of the base 41 is slightly tilted to the rear of the block (i.e., towards ends 35, 39) so that water is allowed to exit at the rear of the block.

Figure 6:
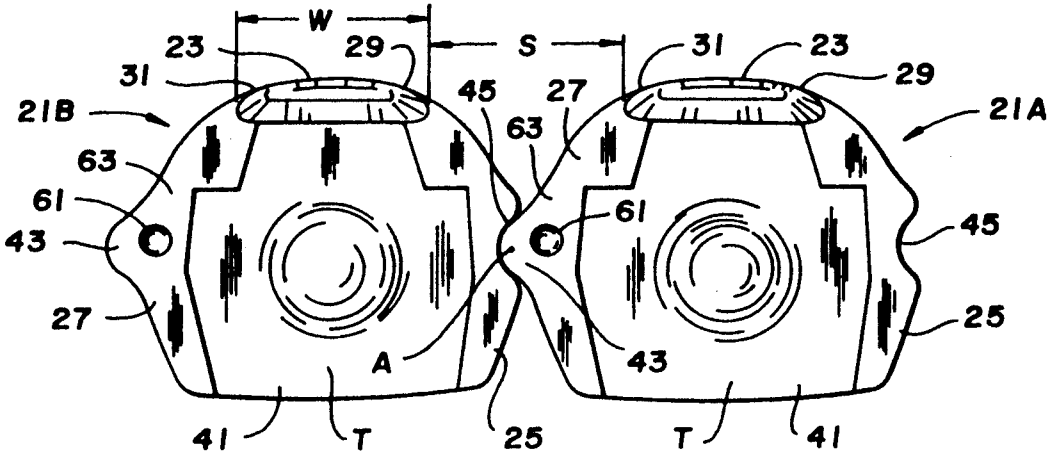
FIG. 6 is a plan view of two building blocks arranged in side-by-side relation with an ear of a first block received in a notch of a second block.

Side wall 27 has a flange or ear 43 (broadly "flange means") projecting outwardly from the side wall for interengagement with a notch 45 (broadly "flange receiving means") formed in the other side wall 25. More specifically, ear 43 is a generally curved protrusion which extends from the wall 27. At ear 43, the wall 27 has a greater thickness than the other portions of the wall, while at notch 45, wall 25 has a reduced thickness relative the rest of the wall. As shown in FIG. 6, when blocks of identical construction are placed in side-by-side relation, the ear 43 of a first block 21A is received by notch 45 of a second block 21B. The interengagement of the ears 43 with the notches 45 of adjacent blocks prevents the forward or rearward movement of a block relative its adjacent blocks. The ear 43 and the notch 45 are located generally between the forward ends 33, 37 and the rearward ends 35, 39 of respective side walls 25, 27. More specifically, the ear 43 and notch 45 are centrally located along side walls 25, 27. However, it is to be understood that the ear 43 and notch 45 may be located anywhere along the side walls 25, 27 so long as they are not positioned too close to the forward ends 33, 37 and the rearward ends 35, 39. The blocks 21A, 21B are allowed to pivot relative one another about a generally vertical axis A while maintaining the ear 43 engaged in the notch 45 such that a plurality of blocks of substantially identical construction may be selectively arranged in a variety of configurations ranging from a generally straight-line configuration, a generally convex configuration and a generally concave configuration. Since the side walls 25, 27 are curved, they do not interfere with the side walls of adjacent blocks, thereby allowing the construction of walls having small radii of curvature formed therein.

Figure 1:
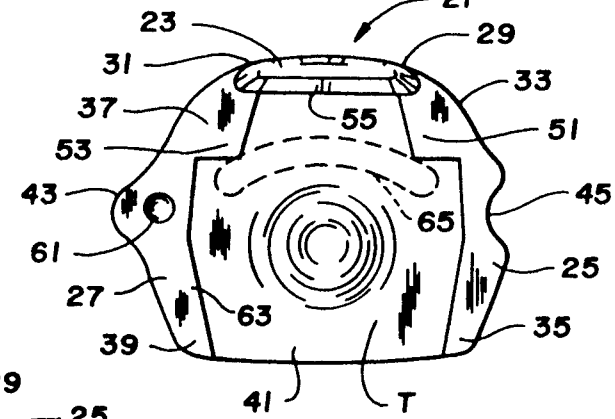
FIG. 1 is a plan view of a retaining wall building block of a first preferred embodiment.
Figure 4:
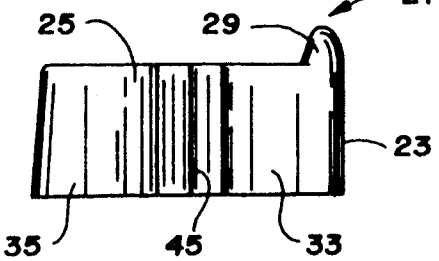
FIG. 4 is a left side elevation thereof.
Figure 5:
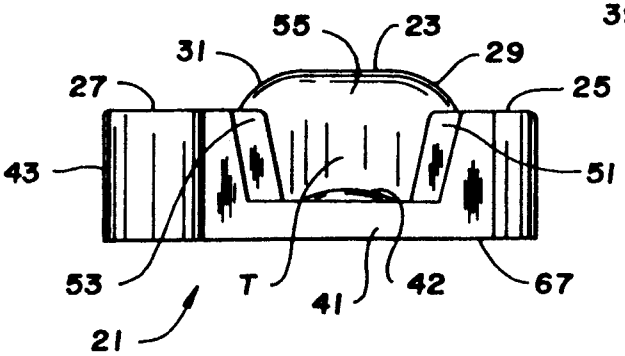
FIG. 5 is a rear elevation thereof.

As shown in FIG. 1, each side wall 25, 27 has a shoulder 51, 53, respectively, located near ends 33, 37 for adding structural stability at the junction where the side walls are attached to the face wall 23. The shoulders 51, 53 are approximately twice as thick in width than the rest of the side walls. Also, the shoulders 51, 53 provide much needed stability in manufacturing the block, since they prevent the collapse of the walls 25, 27 after the block is released from its mold (not shown). Each shoulder 51, 53 extends from the back side 55 of face wall 23 and is integral therewith. Furthermore, shoulders 51, 53 provide an appropriate seating pad for additional courses placed on top of the block. This is especially true for walls having a convex or concave contour, since the top surface of the shoulders is wide enough to receive a block thereon.

Figure 8:
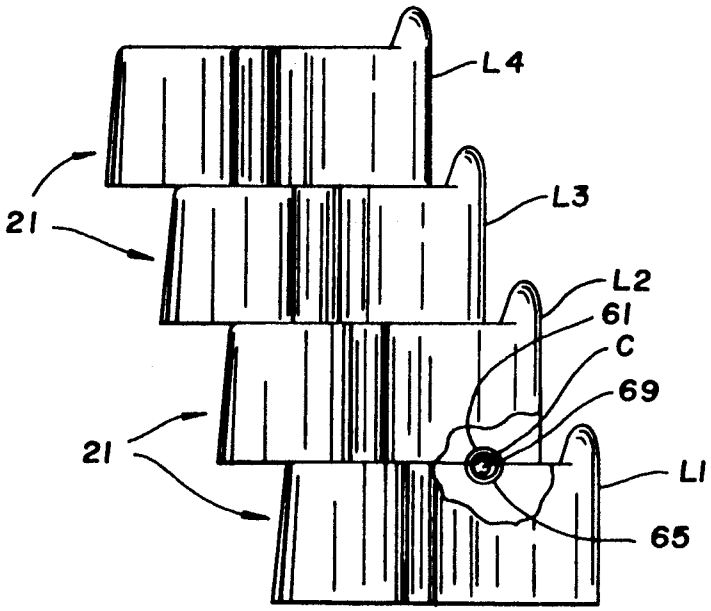
FIG. 8 is a left side elevation of the retaining wall shown in FIG. 7.

Courses are provided (i.e., courses L2, L3, etc.) by stacking the blocks in staggered configuration one on top of another such that a face wall of a block on an upper course (e.g., L2) is positioned generally between two face walls of two blocks positioned on a course immediately below the upper course (e.g., L3). The face wall 23 extends upwardly vertically from a generally horizontal plane higher than side walls 25, 27. In other words, the face wall 23 is higher than the side walls 25, 27. The face wall 23 has a frontal width W1 of generally one-half the functional width W2 of the block 21 (see FIG. 2). The functional width of the block is defined as extending between laterally spaced pivot points on walls 25, 27. Because the face wall extends higher the side walls, and has a width of one-half the width of the block, a vertical wall (i.e., having ninety degree setback) may be constructed when blocks of identical construction are stacked one on top of the other. Setback is defined as the steepness of the face of the wall relative a true horizontal plane, thus a vertical wall would have ninety degree setback. FIG. 8 shows a wall having a setback of approximately seventy degrees, however, as stated, the wall may easily obtain a ninety degree setback As shown in FIG. 6, the space S between the end 31 of face wall 23 of block 21A and the end 29 of face wall of block 21B is substantially the same as the width of the face wall of the block, thereby allowing the face wall of a block on the immediately upper course to fit within the confines of the space.

A hemispherical first recess 61 is provided on the top surface 63 of wall 27 in the area of the ear 43 for mating with a second hemispherical recess 65 on the bottom surface 67 of a second block. When stacking the blocks of identical construction one on top of the other, the first and second recesses 61, 65 are in registry thereby defining a cavity C (see FIG. 8). The cavity C is generally spherical and about three inches in diameter. A detent 69 is receivable in the cavity C for securely positioning the blocks relative one another. Detents 69 assist in preventing the movement of blocks placed on upper courses (e.g., course 2) relative to blocks placed on lower courses (e.g., course 1). Detent 69 is generally spherical and of slightly lesser size than the cavity C. The detent may be made from waste plastic or any other strong material, so long as it prevents the relative movement of the blocks. In its shown embodiment, the second recess 65 is an elongate, arcuate groove which extends substantially the width of the block 21, thereby providing a greater range of positions in which an upper course (e.g., course L2 in FIG. 8) may be placed on an immediately lower course (e.g., course L1 in FIG. 8).

The preferred weight of the building block described thus far is approximately 110 lbs and while it may be used for commercial applications, it is equally suited for residential use. The face wall 23 is about eleven inches high by twelve inches wide, and the two side walls 25, 27 are about eight inches in height by sixteen inches in length. The base 41, which generally defines the transverse cross-sectional area of the block is approximately twenty-four inches in width by sixteen inches in depth. Each wall and the base are approximately two to three inches thick (except, of course, in areas where the ear, notch and shoulders are located), thereby providing substantial structural support.

Figure 9:
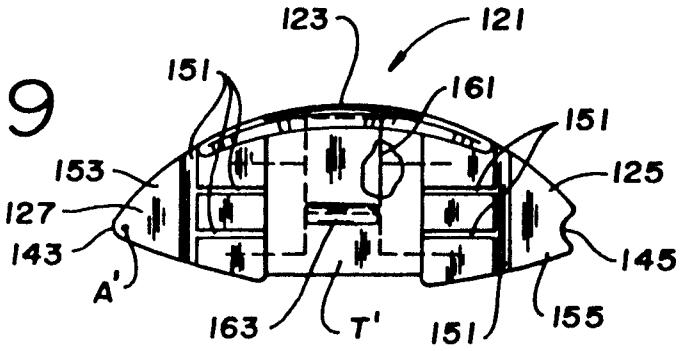
FIG. 9 is a plan view of a building block of a second preferred embodiment.
Figure 10:
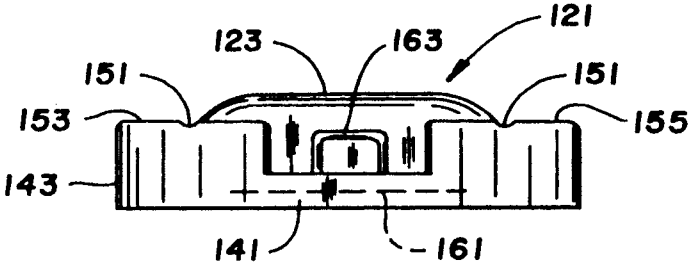
FIG. 10 is a rear elevation of the building block shown in FIG. 9.

In a second preferred embodiment (shown in FIG. 9), block 121 is shaped substantially the same as block 21, but includes a relatively narrower face wall 123 and two shorter side walls 125, 127 extending rearwardly from the face wall. Like block 21, the face wall 123 and the two side walls 125, 127 are shaped and arranged such that the block 121 has a generally C-shaped configuration as viewed from above. Block 121 also comprises an ear 143, which is defined by the shape of the side wall 127, and a notch 145 which function the same way as ear 43 and notch 45 of the first embodiment. The block 121 further includes a series of channels 151 formed on generally planar top surface 153, 155 of each side wall 125, 127. Surfaces 153, 155 slope toward the center of the block to trough T'. The channels 151 are sloped to direct the flow of water from the top surfaces 153, 155 of side walls into the trough T' formed generally centrally in the block. The channels 151 also permit drainage of water trapped behind the block. Like trough T of the first embodiment, the trough T' is sloped towards the rear of the block for allowing water to exit therefrom. Reinforcing steel bars 161 are embedded within the walls 125, 127 and the base 141 of the block 121 for reinforcing the structure of the block. Also shown is a handle 163 formed also from reinforced steel which allows the block to be picked up by a back-hoe (not shown), for instance, for placing the block in its desired position.

Block 121 is designed to be much larger than block 21 for commercial rather than residential applications. The block weighs approximately 400 pounds and is about nine and one-half inches high by fifty-two inches wide by twenty-eight inches deep. The block 121 differs significantly from block 21 in that the side walls 125, 127 are much thicker than side walls 25, 27 of block 21, thereby accounting for much of the increased weight. Backfill placed in trough T' will increase the weight of the block to about 600 pounds.

In manufacturing blocks 21 and 121, a mold member (not shown) comprises at least one cavity having the general configuration of the respective block. Three cavities may be provided in the mold member for making block 21, while just one cavity is provided for making block 121 due to its increased size. The mold member may be made from polyurethane, steel or aluminum, for example. The block may be made from any number of materials, such as concrete (e.g., sand, limestone, cement and water) so long as it maintains its rigidity and stability. A bi-product, such as copper or iron slag, may replace the limestone in the concrete mix for further increasing the strength (because of its increased weight) of the block. Moreover, each component of the block (i.e., face wall 23 and side walls 25, 27) is designed to have a substantial thickness, thereby making it much easier to manufacture since it is nearly impossible for the face wall or the side walls to collapse after the block is formed.

Figure 7:
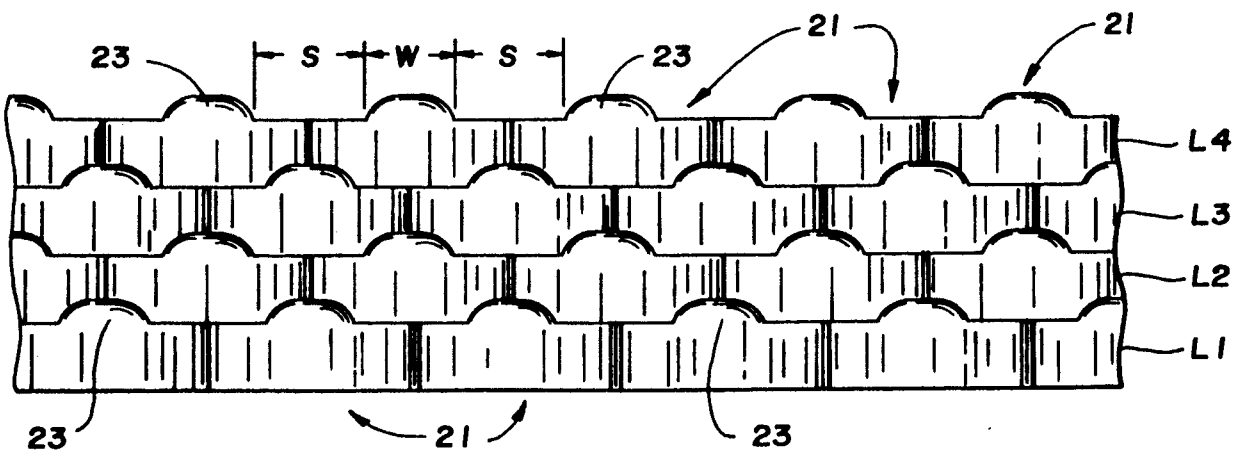
FIG. 7 is a fragmentary front elevation of a retaining wall constructed with building blocks of the type shown in FIG. 1.

In use, a retaining wall (see FIGS. 6–8) is constructed by arranging a plurality of substantially identical building blocks 21 (or 121) in side-by-side relation such that the ear 43 of a first building block (e.g., 21A) engages the notch 45 formed in the block next to the first block (e.g , block 21B). The blocks may be arranged in a variety of configurations, including curves having small radii (i.e., four to seven foot radius depending upon the size of the block), since the blocks are capable of pivoting about axis A (or A'). To prepare for the first course L1, a shallow ditch must be dug in the ground (not shown) so that the first course is properly seated in place. Preferably, the ditch should be sixteen to twenty inches wide by twelve to eighteen inches deep for insuring that the first course is seated properly. A layer of crushed rock is preferably provided below the first course for proper drainage. After the first course L1 is laid in place, additional courses are provided (i.e., courses L2, L3, etc.) by stacking the blocks in staggered configuration one on top of another such that a face wall of a block on an upper course (e.g., L2) is positioned generally between two face walls of two blocks positioned on a course immediately below the upper course (e.g., L3). Fill (not shown) in the form of gravel or dirt may be provided in each trough T (or T') for adding weight to the block, thereby providing additional friction between the courses of blocks. In the case of a retaining wall constructed from blocks 21, a detent 69 may be placed in the cavity C formed between two blocks on differing courses for securely positioning the blocks relative one another. Such detents are not necessary for retaining walls constructed from blocks 121 because the increased weight of the block prevents the relative movement of the blocks. A mesh may also be provided between the blocks which extends generally from the outer edge of the retaining wall into the earth held by the wall. However, either block 21 or 121 may be constructed without the aid of mesh or other stabilizing devices (such as pins) and still provide adequate strength and rigidity.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A retaining wall building block adapted to be placed in side-by-side relation to other building blocks of identical construction, said building block comprising:

a face wall lying generally in a vertical plane and having laterally opposite ends;

two side walls extending rearwardly from the opposite ends of the face wall, said side walls each having forward and rearward ends and a central portion therebetween, said side walls being generally arcuate, extending laterally outwardly and rearwardly from respective opposite lateral edges of the face wall to the central portion, and extending laterally inwardly and rearwardly from the central portion to the rearward end such that the forward end and rearward ends of each side wall are laterally recessed relative to the central portion of each side wall;

flange means projecting outwardly from one of the side walls, said flange means having an engaging surface located generally at the central portion thereof; and flange receiving means in the other of the side walls, said flange receiving means having a generally concave engaging surface located generally at the central portion of said other side wall, the engaging surface of said flange receiving means being adapted to be engaged by the engaging surface of said flange means of one of said other building blocks of identical construction when the blocks are placed in side-by-side relation and to allow the blocks to pivot relative to one another about a generally vertical axis while maintaining said flange means engaged in said flange receiving means, the recessed forward and rearward ends of the side walls relative to the central portions facilitating the pivoting of said blocks about the vertical axis through large angles without disengagement of said flange means from said flange receiving means such that the blocks may be selectively arranged in a variety of side-by-side configurations ranging from a generally straight-line configuration, a generally convex configuration and a generally concave configuration.

2. A building block as set forth in claim 1 wherein said flange means comprises an outwardly arcuately-shaped ear defining the engaging surface of said flange means thereon and having a radius of curvature smaller than the radius of curvature of its side wall, the ear being adapted to engage said flange receiving means when said blocks are placed in side-by-side relation.

3. A building block as set forth in claim 1 wherein said face wall extends upwardly from a generally horizontal plane higher than said side walls and has a width of generally one-half the greatest width of the block.

4. A building block as set forth in claim 1 further comprising a base, said face wall and said side walls projecting upwardly from the base.

5. A building block as set forth in claim 4 wherein the building block is adapted to be stacked on top of one of said other blocks of identical construction, one of said side walls having a first recess formed on the top surface thereof, and the base having a second recess formed on the bottom surface thereof, whereupon when stacking the block upon another block of identical construction having first and second recesses corresponding to the first and second recesses or the block, said second recess of the block is in registry with said first recess of said other block thereby defining a cavity, wherein a removable detent, separate from the block, is receivable in the cavity for securely positioning the blocks relative one another.

6. A building block as set forth in claim 5 wherein said second recess is an elongate groove extending substantially the width of the block.

7. A building block as set forth in claim 1 wherein the face wall is substantially planar.

8. A building block as set forth in claim 1 further comprising structural reinforcement means comprising a plurality of reinforcement bars embedded within the body of the block.

9. A retaining wall building block of the type used in forming a retaining wall and adapted to be selectively placed in side-by-side and stacked relation with other building blocks of identical construction such that adjacently placed blocks are adapted to engage one another and a block of an upper course of blocks is adapted to be seated on two blocks of a lower course of blocks, the building block comprising a face wall lying generally in a vertical plane and having laterally opposite ends, two side walls extending rearwardly from the face wall from the opposite ends thereof, said side walls each having forward and rearward ends and a central portion therebetween, said side walls being generally arcuate, curving laterally outwardly and rearwardly from respective opposite lateral edges of the face wall to the central portion, and curving laterally inwardly and rearwardly from the central portion to the rearward end such that the forward and rearward ends of each side wall are laterally recessed relative to the central portion of each side wall, the face wall and two side walls being shaped and arranged such that the block has a generally arcuate appearance as viewed from above, said face wall extending upwardly from a generally horizontal plane higher than said side walls and having a width, whereby in a generally straight, substantially vertical retaining wall formed of blocks of identical construction, the width of the face wall of each block is less than or equal to the distance between adjacent ends of face walls of two adjacently placed blocks in the wall for facilitating the attainment of a substantially vertical wall.

10. A building block as set forth in claim 9 further comprising flange means projecting outwardly from one of the side walls and having an engaging surface located at the central portion thereof, and flange receiving means in the other of the side walls, said flange receiving means having a generally concave engaging surface located generally at the central portion of said other side wall, the engaging surface of said flange receiving means adapted to be engaged by the engaging surface of said flange means of one of said other building blocks of identical construction when the blocks are placed in side-by-side relation and to allow the blocks to pivot relative to one another about a generally vertical axis while maintaining said flange means in said flange receiving means, the recessed location of the forward and rearward ends of the side walls relative to the central portions facilitating the pivoting of said blocks about the vertical axis through large angles without disengagement of said flange means from said flange receiving means such that the blocks may be selectively arranged in a variety of configurations ranging from a generally straight-line configuration, a generally convex configuration and a generally concave configuration.

11. A building block as set forth in claim 10 wherein said flange means comprises an outwardly arcuately-shaped ear defining the engaging surface of said flange means thereon and having a radius of curvature smaller than the radius of curvature of its side wall, the ear being adapted to engage said flange receiving means when said blocks are placed in side-by-side relation.

12. A building block as set forth in claim 9 further comprising a base, wherein said face wall and said side walls project upwardly from said base.

13. A building block as set forth in claim 12 wherein one of said side walls has a first recess formed on the top surface thereof, and the base has a second recess formed on the bottom surface thereof, whereupon when stacking the block upon another block of identical construction having first and second recesses corresponding to the first and second recesses of the block, said second recess of the block is in registry with said first recess of said other block thereby defining a cavity, wherein a removable detent, separate from the block, is receivable in the cavity for securely positioning the blocks relative one another.

14. A building block as set forth in claim 13 wherein said second recess is an elongate groove extending substantially the width of the block.

15. A building block as set forth in claim 9 wherein the face wall is substantially planar.

16. A building block as set forth in claim 9 further comprising structural reinforcement means comprising a plurality of reinforcement bars embedded within the body of the block.

17. A retaining wall comprising a plurality of substantially identical building blocks placed in side-by-side relation and stacked in a staggered configuration one on top another such that a block on an upper layer is positioned generally between two blocks positioned on a layer immediately below said upper layer, each building block comprising a face wall lying generally in a vertical plane and having laterally opposite ends, two side walls extending rearwardly from the face wall from the opposite ends thereof, said side walls each having forward and rearward ends and a central portion therebetween, said side walls being generally arcuate, extending laterally outwardly and rearwardly from respective opposite lateral edges of the face wall to the central portion, and extending laterally inwardly and rearwardly from the central portion to the rearward end such that the forward and rearward ends of each side wall are laterally recessed relative to the central portion of each side wall, flange means projecting outwardly from one of the side walls, said flange means having an engaging surface located generally at the central portion thereof, and flange receiving means in the other of the side walls, said flange receiving means having a generally concave engaging surface located generally at the central portion of said other side wall, the engaging surface of said flange receiving means being adapted to be engaged by the engaging surface of said flange means of one of said other building blocks of identical construction when the blocks are placed in side-by-side relation and to allow the blocks to pivot relative to one another about a generally vertical axis while maintaining said flange means in said flange receiving means, the recessed forward and rearward ends of the side walls relative to the central portions facilitating the pivoting of said blocks about the vertical axis through large angles without disengagement of said flange means from said flange receiving means such that the blocks may be selectively arranged in a variety of configurations ranging from a generally straight-line configuration, a generally convex configuration and a generally concave configuration.

18. A retaining wall as set forth in claim 17 wherein said blocks each comprise a trough formed between said face wall and said side walls, said retaining wall further comprising earth fill placed in said troughs for in part securing said building blocks relative one another.

19. A retaining wall as set forth in claim 18 wherein the retaining wall, as viewed from the front, conceals the earth fill disposed in spaces between adjacent blocks, but shows a continuous formation of face walls of the building blocks forming the retaining wall.

20. A retaining wall as set forth in claim 17 wherein said flange means comprises an outwardly arcuately-shaped ear defining the engaging surface of said flange means thereon and having a radius of curvature smaller than the radius of curvature of its side wall, the ear being adapted to engage said flange receiving means when said blocks are placed in side-by-side relation.

21. A retaining wall as set forth in claim 17 wherein said face wall extends from a generally horizontal plane higher than said side walls and has a width of generally one-half the greatest width of the block.

22. A retaining wall as set forth in claim 17 further comprising a base, wherein said face wall and said side walls project upwardly from said base.

23. A retaining wall as set forth in claim 22 wherein one of said side walls has a first recess formed on the top surface thereof, and the base has a second recess formed on the bottom surface thereof, whereupon when stacking the block upon another block of identical construction having first and second recesses corresponding to the first and second recesses or the block, said second recess of the block is in registry with said first recess of said other block thereby defining a cavity, wherein a removable detent, separate from the block, is receivable in the cavity for securely positioning the blocks relative one another.

24. A retaining wall as set forth in claim 23 wherein said second recess is an elongate groove extending substantially the width of the block.

25. A building block as set forth in claim 17 wherein the face wall is substantially planar.

26. A building block as set forth in claim 17 further comprising structural reinforcement means comprising a plurality of reinforcement bars embedded within the body of the block.

* * * * *